US005372687A

United States Patent [19]

Pohto et al.

[11] Patent Number: 5,372,687

[45] Date of Patent: Dec. 13, 1994

[54] CATHODIC PROTECTION DISK ANODE

[75] Inventors: Gerald R. Pohto, Mentor; H. Kirk Fowler, Madison, both of Ohio; Donald J. Groszek, Sugar Land, Tex.

[73] Assignee: Eltech Systems Corporation, Chardon, Ohio

[21] Appl. No.: 106,666

[22] Filed: Aug. 16, 1993

[51] Int. Cl.[5] ..... C23F 13/00

[52] U.S. Cl. ..... 204/196; 204/280; 204/286; 204/290 R

[58] Field of Search ..... 204/196, 280, 290 R, 204/290 F, 286

[56] References Cited

U.S. PATENT DOCUMENTS 4,445,989 5/1984 Kumar et al. ..... 204/147
4,946,570 8/1990 Kumar et al. ..... 204/196

OTHER PUBLICATIONS

Ceranode, Life-Saver-Anode Brochure, Underwater Connector version (no date available).

Ceranode, Life-Saver-Anode brochure, terminal lug (no date available).

Brochure drawing, disk anode, crimp connection type (no date available).

*Primary Examiner*—John Niebling
*Assistant Examiner*—Kishor Mayekar
*Attorney, Agent, or Firm*—John J. Freer

[57] ABSTRACT

A cathodic protection anode assembly for metal structures in water is now provided with highly desirable rugged construction. The assembly is particularly useful for providing cathodic protection utilizing an anode, in submersed condition, on one side of a structure while having an assembly protruding through an opening in the structure with a connection at the back side of the structure to a lead-in cable. Such structure may have the back side in ambient air. For the back side structure, the assembly has a highly desirable leak resistant characteristic. Moreover, the assembly can provide efficient low contact voltage at the anode and cable connection.

47 Claims, 3 Drawing Sheets

CATHODIC PROTECTION DISK ANODE

BACKGROUND OF THE INVENTION

It has been known to provide anodes useful in corrosion protection of parts immersed in water, such as lock gates in canals. For example, U.S. Pat. No. 4,445,989 shows an anode assembly mounted through a metal member which is part of an underwater structure that is to be protected against corrosion. The assembly protrudes through an opening in the member and projects an anode into the underwater side of the structural member. On the reverse side of the metal member, the assembly is tightly fastened to the member.

These anode assemblies, which are designed for immersion typically on the front side only, may have an anode in disk form. The disk form anode can be held in pressed contact against a dielectric which is placed between the anode and the metal member to be protected, such as a dam gate. At the backside of the member, the anode assembly can be provided with means for securing the assembly to the metal member. Additionally, the back side assembly can include means for connecting a cable, usually a plug-in means. The cable can be connected with a metal element projecting from the anode in the form of a mounting stud. A protective cap can beplaced over the plug-in-means and stud at the zone of connection.

It has also been known to provide connection between a disk anode connecting pin and a connecting cable by using a crimp connection, crimping to both the pin and the cable, which connection may additionally be soldered on the cable.

There has however remained a need to obtain a highly desirable low voltage electrical contact between the anode portion of the assembly and the lead in cable while supplying rugged construction serviceable for commercial installations. It would also be desirable to have the assembly, including the connections, of sufficient strength to easily support the anode in commercial practice. Moreover, any immersed portion of the structure should be free from leakage, e.g., at the anode side, or front side, of the structure.

SUMMARY OF THE INVENTION

There is now provided a rugged anode assembly suitable for use by mounting through a structural member. The assembly can have a submerged anode on one side of the member, with the balance of the anode assembly on the other side of the member being also submerged, or exposed in ambient air. The assembly has highly desirable freedom from leakage. It is economical to produce and has enhanced ease of assembly, as well as provides ready connection to a cable. Yet it is sufficiently rugged to meet the requirements of the most demanding commercial practice.

Broadly, in one aspect, the invention is directed to a cathodic protection anode assembly for metal structures in water wherein a plate anode having front and back major faces is spaced apart by dielectric insulation, also having front and back major faces, from the metal structure to be protected, which anode assembly comprises, in sequence:

(A) an assembly first stage, including said plate anode positioned on the front face of said dielectric insulation, with the back face of said insulation facing the metal structure, said assembly first stage also including an extension section protruding through an aperture in said metal structure, which extension section comprises:

(1) an inner, metal anode terminal rod having a fixed end secured in electrical contact to the back face of said plate anode;

(2) an insulating sleeve around, but spaced apart from, said anode terminal rod; and (3) filler in the space between said anode terminal rod and said sleeve;

(B) an assembly second stage behind said first stage, which second stage is housed within the insulating sleeve of said first stage and comprises:

(1) a wire lead free end for connecting with a free end of said anode terminal rod;

(2) a terminal connector securing the free ends of said anode terminal rod with said wire lead; and (3) a two-part connector sleeve of dielectric material, the connector sleeve being housed within the insulating sleeve of said first stage, with each connector sleeve part being aligned annularly in said insulating sleeve, which connector sleeve parts surround the free end of said anode terminal rod, wire lead and terminal connector; and (C) an assembly third stage behind said second stage, said third stage comprising:

(1) a wire extending therethrough from outside said anode assembly; and (2) a sleeve member surrounding said wire and spaced apart therefrom, said sleeve member comprising a pipe union member.

In another aspect, the invention is directed to a cathodic protection anode assembly having an assembly first stage as described hereinabove in combination with a conduit assembly secured to a back portion of the aforesaid insulating sleeve, with the conduit assembly surrounding a cable, while comprising a pipe union member.

In a still further aspect, the invention is directed to a cathodic protection anode assembly which includes as a third stage a junction assembly for connecting a lead wire with the metal terminal rod, which connection is made in a housing for the junction assembly located behind a pipe union member.

DESCRIPTION OF THE PREFERRED EMBODIMENTS

Disk anodes can be useful in cathodic protection of articles which are in contact with water such as a wharf, lock gate in a canal, dam level control gate, caisson, tank or large pipe. For protecting many of these articles, the anode can be a flat plate which conforms to a large flat face of the article to be protected. However, in some instances, such as inside a tank, the assembly is presented with a curved surface. This may be a concave or a convex curved surface. The anode may be curved in these instances to conform to these surfaces. Or, such as inside a tank, if the anode is a flat plate, it will be understood that the anode assembly will not conform to the inside curved surface of the tank. Also in many installations only the anode side of the anode assembly is immersed, e.g., as in a tank. However, it will be understood that both sides of the assembly can be immersed, as for an installation in a caisson where the assembly is on both sides of a steel wall.

Figure 1:
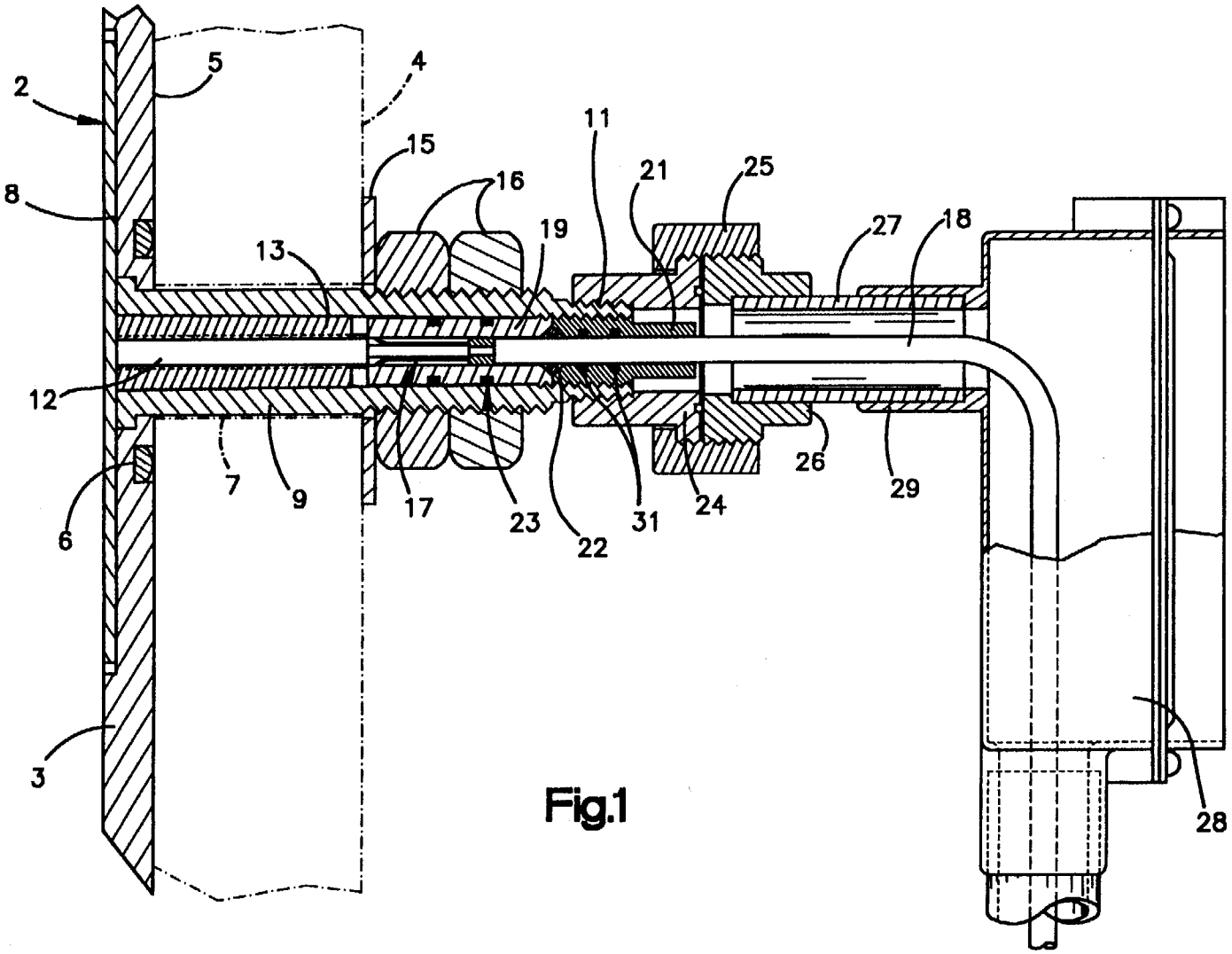
FIG. 1 is a cross-sectional view of a cathodic protection anode assembly having an anode element on one side of a metal member and on the other side an electrical connection assembly for supplying an electrical current to said anode through a lead-in cable connecting to an anode terminal rod.

Referring now to FIG. 1, there is shown the aspect of the invention involving a flat plate anode 2. This anode has front and back major faces and is abutted against a dielectric shield 3, which itself has front and back major faces. The anode 2 is positioned in a recessed area on the broad flat front face of the larger, plate-shaped dielectric shield 3. The dielectric shield 3 has a peripheral beveled edge and is positioned so that it has its broad flat back face in snug fit against the front of a wall-like area of a metal member, e.g., a bulkhead 4, which is to receive cathodic protection. In the aspect of the invention where the anode 2 and shield 3 are used in conjunction with a curved bulkhead 4, both the anode 2 and shield 3 may be curved to conform to the bulkhead 4. To firmly secure the dielectric shield 3 to the bulkhead 4, it is advantageous to apply an adhesive layer 5, such as of a polysulfide rubber sealant or caulking compound, to adherently secure the shield 3 to the bulkhead 4. The back face of the anode 2 may be adhesively bonded to the dielectric shield 3 by a bonding layer 8, such as by an epoxy adhesive. Although the whole anode 2, i.e., front face, back face and sides, may be coated, e.g., electrocatalytically coated, generally the major amount of such coating will be on the front face. A groove on the back face of the shield 3, is filled typically with a gasket or o-ring 6, e.g., an ethylene-propylene terpolymer elastomer (EPDM) gasket which can be a molded-in-place gasket 6, which is thus embedded in the shield 3 and serves as a primary seal between the anode 2 and bulkhead 4. Typically, this gasket or o-ring 6 is adhesively bonded in the groove of the shield 3. Where the anode assembly is presented with a curved surface, this gasket or o-ring 6 may extend outwardly from the back face of the shield 3 sufficiently to preclude contact of the shield 3 with the bulkhead 4, even after installation of the anode assembly.

Within the perimeter of this gasket 6 is a hole 7 through the bulkhead 4. Projecting through the hole 7 in the bulkhead 4 is a sleeve 9 which also projects through a hole in the center of the shield 3. The front portion of the sleeve 9 can be affixed to the shield 3 at this juncture of these elements. The sleeve 9 extends rearwardly from the anode 2 through the hole 7, and projects further away from the back of the bulkhead 4, finally terminating at its far back end in a sleeve neck 11. The outside wall of the sleeve 9 that is behind the bulkhead 4, including the sleeve neck 11, may be threaded. Also, the inside wall of the sleeve 9, at its far, rearwardly projecting end, can be threaded. Within the shield 3, the sleeve 9 will typically be flanged, having an outer flange at the end of the sleeve 9. In this configuration, the shield 3 is also flanged, i.e., has an inner flange at the hole within the shield 3, whereby the inner flange of the shield 3 comes together with, and presses axially against, the outer flange of the sleeve 9 to form a tightly-fitting, interlocking joint. Hereinafter for convenience this configuration may simply be referred to as the "interlocking joint". In this joint, the sleeve 9 can be further secured to the shield 3, such as by adhesive bonding, as with an epoxy cement. Centrally located within the hollow area of the sleeve 9, but spaced apart from the sleeve 9, is an anode terminal rod 12 which is secured to the back face of the anode plate 2, which can be done by welding. In the space between the anode terminal rod 12 and the sleeve 9 is a filler 13, such as an epoxy potting compound. The sleeve 9 can be tapered, permitting more filler 13 toward the anode 2 than toward the sleeve neck 11. At the back of the bulkhead 4, the sleeve 9 can be secured in place, such as by a washer 15 and nuts 16. For convenience, the grouping comprising the anode 2, shield 3, anode terminal rod 12, insulating sleeve 9 and filler 13 will sometimes be referred to herein simply as the "assembly first stage".

The rearward end of the anode terminal rod 12 is inserted in a terminal connector 17 which is engaged, such as by crimp fitting, with the free end of a lead wire, or cable, 18. The anode terminal rod 12 at its rearward end, may be conditioned for enhanced electrical connection, as by plating. This rearward end of the terminal rod 12, as well as adjacent end of the cable 18, plus the terminal connector 17, are further housed within a main connector sleeve 19. Behind this main connector sleeve 19 is a connector sleeve with wrenching flats 21 which is threaded on the portion of its outside wall other than the wrenching flats. Between this connector sleeve with wrenching flats 21 and the main connector sleeve 19 there may be an internal o-ring 22, placed around the cable 18, for sealing between the connectors 19, 21. The main connector sleeve 19 can have external o-rings 23 for sealing between this main connector sleeve 19 and the inside wall of the sleeve 9. Furthermore, the connector sleeve with wrenching flats 21 can have internal o-rings 20 for sealing between this sleeve 21 and the cable 18. For convenience, and when referring to FIG. 1, the grouping comprising the lead wire 18, terminal connector 17 and connectors 19, 21 will sometimes be referred to herein simply as the "assembly second stage" which is positioned "behind the assembly first stage".

At its far back end, the sleeve 9 is joined, such as by a threaded fastening engagement at the sleeve neck 11, with a pipe union comprising a female threaded half 24, a socket half 26 and a union nut 25. An o-ring can be placed between the female threaded half 24 and the socket half 26. The socket half 26 can be fitted around a pipe 27 which connects to a conduit box assembly 28 at a conduit box socket 29. The cable 18 runs through the conduit box assembly 28, typically connecting directly to a rectifier (not shown).

In assembling the cathodic protection anode assembly of FIG. 1, a plate anode 2, having typically an electrocatalytic coating, can be secured such as by welding to an anode terminal rod 12. The flanged end of the sleeve 9 is then secured, such as by cementing, to the dielectric shield 3. The back face of the anode 2 can then be adhesively secured into the front recess of the dielectric shield 3. The void area between the sleeve 9 and the anode terminal rod 12, for usually that length of the void area extending to essentially the thickness of the bulkhead 4, is then be filled with filler 13. A gasket or o-ring 6 is secured into the groove on the back face of the shield 3. These elements up to this point, as an anode preassembly, can be assembled away from the installation site and shipped to the site in this assembled manner.

The female threaded half 24, union nut 25 and socket half 26 are typically assembled. Thereafter, the socket half 26 can be secured, such as by solvent welding, to the pipe 27, and the pipe 27 to the conduit box socket 29 which then, along with at least the main housing of the conduit box 28, can provide a preassembly. This preassembly, which may be referred to herein for convenience as the "conduit box preassembly" may be assembled away from the installation site and shipped thereto.

At the site, the anode preassembly is then ready for insertion within the bulkhead hole 7. Accompanying this, the back face of the shield 3 is adhesively affixed to the bulkhead 4. Upon insertion, the washer 15 and nut 16 can be placed on the sleeve and tightened. The lead end of the cable 18 is fed through the conduit box preassembly. Then the connector sleeve with wrenching flats 11, with internal o-rings 20 in place, is slid over the cable 18, wrenching flats 11 first. The internal o-ring 22 is next slid over the cable 18 and up against the connector sleeve 11. Following this, the main connector sleeve 19, with external o-rings 23 in place, can be slid over the cable 18 and abut against the in-place internal o-ring 22 and sleeve 11. Next there is exposed a small part of the lead of the cable 18 extending beyond the main connector sleeve 19. To this exposed end of the cable 18, there is fastened, as by crimping, a portion of the terminal connector 17. The cavity in the remaining portion of the terminal connector 17 and the area around the terminal connector 17 within the main connector sleeve 19 can then have applied thereto an electrically conductive, preferably water repellant contact lubricant such as a silicone contact grease. The cable 18 is pulled back to pull the terminal connector 17 into the sleeve 19. The resulting assembly is then pushed into the sleeve 9 and over the anode terminal rod 12. The connector sleeve with wrenching flats 21 is threaded into the sleeve 9 by turning on the wrenching flats 21, thereby providing a tight, quick connection between the cable 18 and the anode terminal rod 12. The anode preassembly can then be connected with the conduit box preassembly, by securing the female threaded half 24 to the connector sleeve 11 and tightening the union nut 25 to complete the assembly.

In disassembly, the threaded coupling between the female threaded half 24 and sleeve neck 11 permits ready disassembly to expose the wrenching flats 21. Upon unthreading and removing the connector sleeve with wrenching flats 21, the cable 18 may be forcibly pulled out together with the main connector sleeve 19. Then the nuts 16 and washer 15 are readily removed. The remaining assembly may be punched loose from the hole 7.

Figure 2:
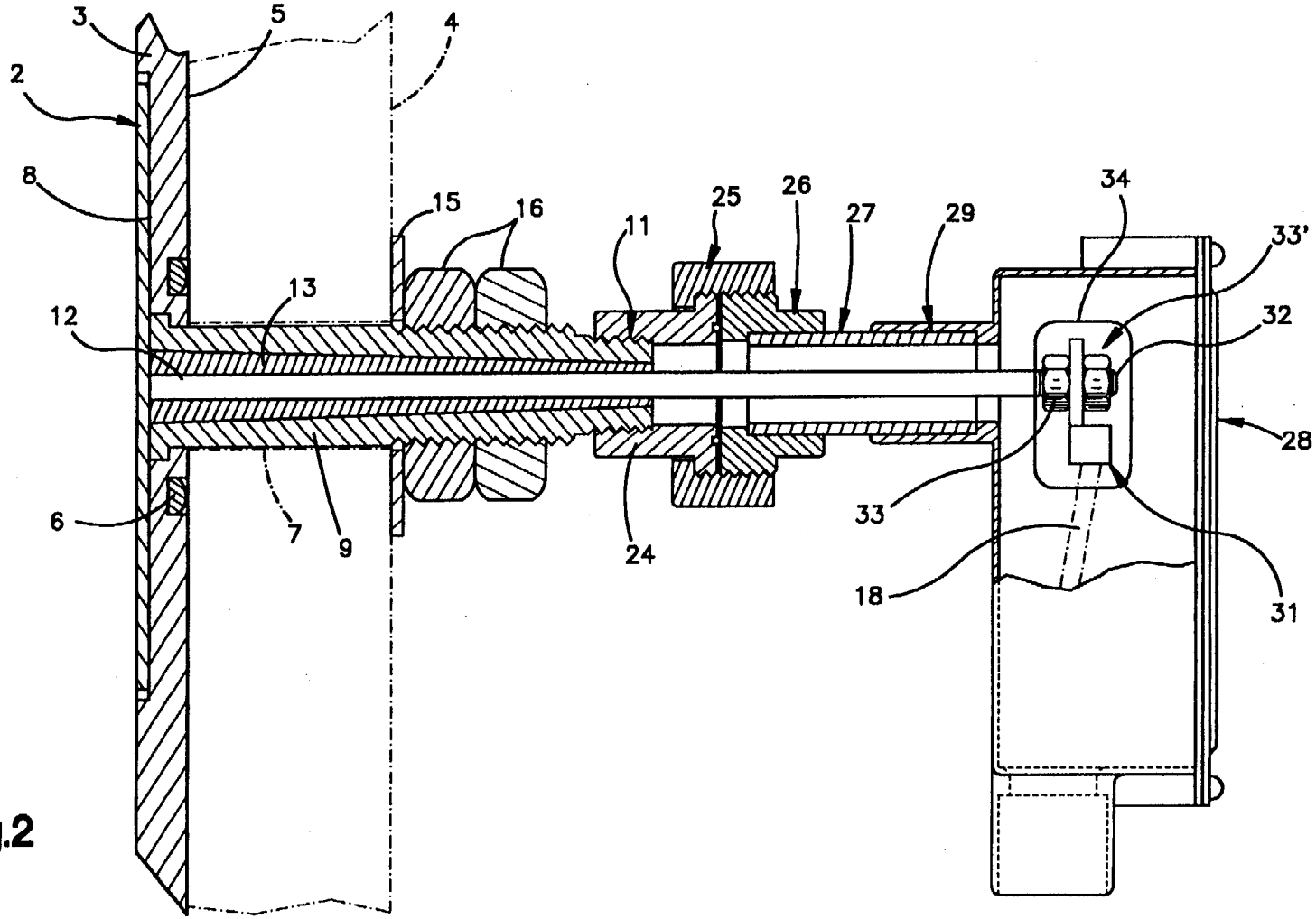
FIG. 2 is a cross-sectional view of an anode assembly similar to FIG. 1, but having an anode terminal rod connecting to a lead-in cable at a junction box.

Referring next to FIG. 2, there is shown another aspect of the invention involving a flat plate anode 2. For this aspect, the back face of a flat plate anode 2 is positioned, in a recessed area on a broad flat front face of a larger, plate-shaped dielectric shield 3. The back face of the dielectric shield 3 is positioned snugly against the face of a bulkhead 4. To firmly secure the dielectric shield 3 to the bulkhead 4, it is advantageous to apply an adhesive layer 5, such as of a polysulfide sealant or caulking compound, to adherently secure the shield 3 to the bulkhead 4. The back face of the anode 2 may also be adhesively bonded to the dielectric shield 3 by a bonding layer 8, such as of epoxy cement. The front face of the anode 2 may be coated, e.g., electrocatalytically coated, particularly on its front face. A groove in the back face of the shield 3 is filled typically with a gasket or o-ring 6, e.g., an EPDM gasket, serving as a primary seal between the anode 2 and bulkhead 4. Usually, this gasket or o-ring 6 is adhesively bonded in the groove of the shield 3.

Within the perimeter of this gasket 6 is a hole 7 through the bulkhead 4. Projecting through the hole 7 is a sleeve 9 which also projects through a hole in the center of the shield 3. The sleeve 9 extends rearwardly from the anode 2 through the hole 7, finally terminating at its far end in a sleeve neck 11. The outside wall of the sleeve 9 that is behind the bulkhead 4, including the sleeve neck 11, may be threaded. Within the shield 3, the sleeve 9 will typically be flanged and secured to the shield 3, e.g., by adhesive bonding as with an epoxy cement. Located centrally within the hollow area of the sleeve 9, but spaced apart from the sleeve 9, is an anode terminal rod 12 which is secured to the back face of the anode plate 2, as by welding. Between the anode terminal rod 12 and the sleeve 9 is a filler 13, such as an epoxy potting compound. The sleeve 9 may be tapered, so that the amount of filler lessens in cross-section in a direction rearwardly of the anode 2. At the back of the bulkhead 4, the sleeve 9 is secured in place, which can be done by a washer 15 and nuts 16. It will be understood that an anode preassembly comprising the anode 2, shield 3, gasket 6, sleeve 9, rod 12 and filler 13 can be assembled away from an installation site and delivered for use as a preassembly.

The far rearward end of the sleeve 9 is joined by threaded fastening engagement at the sleeve neck 11, with a pipe union comprising a female threaded half 24, a socket half 26 and a union nut 25. The socket half 26 can be fitted around a pipe 27 which connects to a conduit box assembly 28 at a conduit box socket 29. For convenience, this pipe union may be referred to herein, when discussing FIG. 2, as a "conduit assembly", and it may also include by this reference the pipe 27. When reference is to be made to this pipe union in FIG. 1, it may be called the "assembly third stage" and is behind the second stage as depicted in FIG. 1 and discussed hereinabove. In FIG. 2, the pipe union is followed by a "junction assembly" as will now be discussed.

The anode terminal rod 12 is threaded (not shown) at its free end and may be conditioned, e.g., such as by plating, which is typically platinum plating, to maintain a low contact voltage at the connection with the cable 18. Connection for the rod 12 is made with the cable 18 by means of a cable terminal 31 secured around the threaded end 32 of the rod 12 and tightened thereto with nuts 33, 33'. The connection can be protected from corrosion by a protective envelope 34 such as provided by a sealant, e.g., a silicone sealant, or by wrapping as with petrolatum tape, or as provided by a heat shrunk tube, which can be an olefin polymeric tube heat shrunk around the connection. The cable 18 then runs through the conduit box assembly 28 from the cable terminal 31, typically to a rectifier (not shown).

Figure 3:
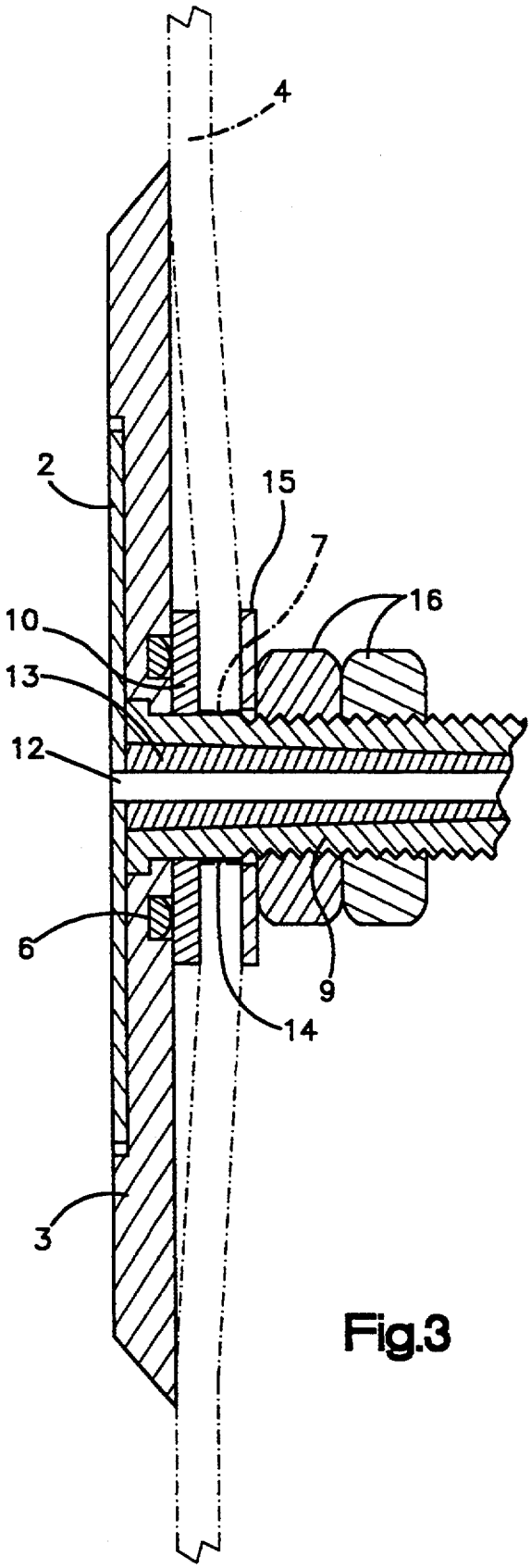
FIG. 3 is a cross-sectional view of a portion of the cathodic protection anode assembly of FIG. 1 mounted against a concave metal member.

Referring now to FIG. 3, the back face of a flat plate anode 2, is positioned in a recessed area on the broad flat front face of a larger, plate-shaped dielectric shield 3. The dielectric shield 3 is mainly spaced away from (touching at only two points) a concave metal member 4. Between the metal member 4 and the shield 3 is a spacer 10, make from a material such as EPDM or a fluoroelastomer. The spacer 10 fills a portion of the space, and is sandwiched between, the flat plate anode 2 and concave metal member 4. The balance of this space could also be filled, if desired. A groove on the back face of the shield 3, is filled typically with a gasket or o-ring 6, e.g., an ethylene-propylene terpolymer elastomer (EPDM) gasket which can be a molded-in-place gasket 6, which is thus embedded in the shield 3. This gasket 6 is abutted up against the spacer 10 and serves as a primary seal between the anode and bulkhead 4. Typically, this gasket or o-ring 6 is adhesively bonded in the groove of the shield 3. It is also contemplated that the gasket 6 may be sufficiently enlarged such that the spacer 10 need not be utilized.

Within the perimeter of this gasket 6 is a hole 7 through the bulkhead 4. Projecting through the hole 7 in the bulkhead 4 is a sleeve 9 which also projects through a hole in the center of the shield 3. The sleeve 9 extends rearwardly from the anode 2 through the hole 7, and projects further away from the back of the bulkhead 4. The outside wall of the sleeve 9 that is behind the bulkhead 4 may be threaded. Within the shield 3 the sleeve 9 will typically be flanged and secured to the shield 3, such as by adhesive bonding, as with an epoxy cement. Centrally located within the hollow area of the sleeve 9, but spaced apart from the sleeve 9, is an anode terminal rod 12 which can be secured within an aperture at the center of the anode plate 2, which can be done by welding. In the space between the anode terminal rod 12 and the sleeve 9 is a filler 13, such as an epoxy potting compound. The front portion of the outside wall of the sleeve 9 can be covered with an adhesive layer 14, e.g., polysulfide based sealant, bonding the sleeve 9 to the bulkhead 4. This adhesive layer 14 provides a secondary seal for the anode 2, with the gasket or o-ring 6 serving as the primary seal. At the back of the bulkhead 4, the sleeve 9 can be secured in place, such as by a washer 15 and nuts 16.

Referring again to FIG. 1, as has been noted hereinbefore, the plate anode 2, particularly on its front face, may contain an electrocatalyically active coating, such as a mixed metal oxide coating on a titanium plate anode, as will be more specifically discussed hereinbelow. As mentioned hereinbefore, the anode 2 need not be a flat plate, e.g., it could be a concave plate so as to conform to a concave metal member 4 as shown in FIG. 3. The shield 3 in FIG. 3 may also be concave, thus abutting entirely up against the metal member 4. Likewise, the anode 2 and shield 3 could be convex to conform to a convex metal member 4. Within the groove at the back face of the shield 3 it is preferred for best sealing that the gasket or o-ring 6 which is affixed in such groove, extend outwardly beyond the back face of the shield 3 before installation. Thereafter, it is preferred that this gasket or o-ring 6 be sufficiently compressible so as to assure a flush mounting of the shield 3 and the gasket or o-ring 6 with the face of the metal member 4 upon installation of the shield 3 to the metal member 4.

In general, the plate anode 2 will be a metal anode, and this can be any valve metal, e.g., titanium, tantalum, niobium, zirconium and the like, with titanium being the preferred metal, and including anodes of metal alloys and intermetallic mixtures. Typically, the anode will have an overall circular, or plate, shape although other shapes, e.g., oval or square, are contemplated. For a circular plate anode 2 the dielectric shield 3 will typically have a diameter on the order of from 1 ½ to 3 times the diameter of the anode. More usually, the shield 3 will be about twice the diameter of the anode 2. More particularly, a titanium plate anode 2 having a diameter of approximately 5 to 20 inches can be secured to a shield 3 of approximately 12 to 30 inches diameter. Similar dimensions can be utilized for anodes 2 and shields 3 of other than circular, i.e., disk, shape. Generally, the plate anode 2 will have a thickness of on the order of as little as 1/16 inch up to ½ inch. Comparatively, the thickness for a metal member such as a bulkhead is typically on the order of from ¼ inch up to 6 inches.

Advantageously, the shield 3 will be thicker than the anode 2 to provide desirable insulating characteristic between the anode 2 and the metal member 4 to be cathodically protected. The shield 3 can be on the order of ¼ inch to ¾ inch thick, particularly for use with flat metal members 4, but may be thicker for curved members such as the concave metal member 4 of FIG. 3. The shield 3 may be supplied by any electrically non-conductive typically polymeric material such as a fiberglass-reinforced plastic (FRP) utilizing, for example, a resin such as polyester, epoxy or polypropylene. FRP materials are preferred for economy and efficient dielectric characteristic. It is also contemplated that for these reasons the sleeve 9, main connector sleeve 19, connector sleeve with wrenching flats 21, washer 15 and nuts 16 will be made from FRP, although other polymeric materials as noted hereinbefore may be useful.

It is contemplated that the anode terminal connector rod 12 will be a metal rod 12, e.g., a valve metal, with titanium being preferred. It is to be understood that the metal of the rod might be an alloy or intermetallic mixture or other combination, including copper clad titanium. The filler 13 that helps secure the rod 12 within the sleeve 9 may be any electrically non-conductive material which fills the requisite void and maintains a secure contact between the exterior surface of the anode terminal rod 12 and the inside wall of the sleeve 9. An epoxy potting compound has been found to be most useful. For anodes sized as discussed hereinbefore, there will usually be used a sleeve 9 of about 1¼ inch diameter requiring a hole 7 through the bulkhead 4 of typically 1 5/16 inch diameter. The adhesive layer 14 between the sleeve 9 and the bulkhead 4 is preferably adhesively filled with a sealant such as a polysulfide based sealant. Where the shield 3 is fitted around the sleeve 9, this joint may be also secured with an adhesive layer, e.g., an epoxy adhesive.

To enhance electrical contact, e.g., to maintain a low contact voltage at the lead end of the cable 18, where plating is used for this purpose it will typically be platinum plating, however other plating is contemplated. Thus, the terminal connector 17 may be a silver plated beryllium copper terminal connector 17. The terminal connector 17 may be generally cylindrical in shape. In crimping over the exposed end of the cable 18, the cylinder at this portion may be imperforate. Beyond the cable 18, surrounding the anode terminal rod 12, the cylinder may be slit, and edges at the slits can be bent inwardly to form flaps. The rod 12 can be larger than the opening formed by these inwardly bent flaps. When the rod 12 is inserted in the cylindrical connector 17 of this form, the flaps will gouge into the surface of the rod 12 as it slides toward the cable 18, providing highly desirable electrical contact. When the rod 12 slides into contact with the flaps they gouge or cut into the rod and also spring slightly open to provide a spring fit. Thus, the connector 17 can have a crimp fit with the wire 18 and a spring fit with the terminal rod 12. As the rod 12 is inserted in the connector 17, contact lubricant can be squeezed into the slits of the connector 17 and fill between the rod 12 and the connector 17 to enhance electrical contact therebetween.

For the pipe union, including the female and socket halves 24 and 26, and nut 25, as well as including the pipe 27 and socket 29, it is contemplated that any typically wear-resistant polymeric material will be serviceable. For efficiency and economy, polyvinylchloride (PVC) is preferred. It will be usual to use a ¾ inch pipe union. Metal pipe unions may also be serviceable. When the electrical connection behind the bulkhead 4 may be immersed, it will be desirable to protect around the electrical elements, e.g., the connector sleeve with wrenching flats 11, the terminal rod 12 and the cable terminal 31, with an outer cover (not shown) such as a plastic foam, heat shrunk protective envelope or silicone caulk. Also the conduit box 28 can be filled, as with an epoxy sealant.

In FIG. 2, the connection between the anode terminal rod 12 and cable 18 can be made at the threaded end 32 of the rod 12 which may be plated, e.g., platinum plated, for best electrical connection. The nuts 33, 33' at the connection will serviceably be electrically conductive metal nuts such as nickel plated steel hex nuts. For the cable terminal 31 a spade or ring connector sized for the anode terminal rod 12 is contemplated. For the connection, the terminal connector may be plated, e.g., tin plating, for enhanced electrical connection. As mentioned hereinbefore, the totality of the connection may then be encased in a sealant or covering.

As also mentioned hereinbefore, the whole anode 2, including the front face, back face and sides may be coated with an electrocatalytically active coating. Such anode can be particularly serviceable where the anode may be subject to crevice corrosion, as in an installation where the anode may come into contact with a salt in solution, such as immersion in salt water or brackish water. As representative of the electrochemically active coatings that may be applied on the front face of the anode 2, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385, and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include manganese dioxide, lead dioxide, cobalt oxide, ferric oxide, platinate coatings such as $M_xPt_3O_4$ where M is an alkali metal and X is typically targeted at approximately 0.5, nickel-nickel oxide and nickel plus lanthanide oxides.

We claim:

1. A cathodic protection anode assembly for metal structures in water wherein a plate anode having front and back major faces is spaced apart by dielectric insulation, also having front and back major faces, from the metal structure to be protected, which anode assembly comprises, in sequence:

(A) an assembly first stage, including said plate anode positioned on the front face of said dielectric insulation, with the back face of said insulation facing said metal structure, said assembly first stage also including an extension section protruding through an aperture in said metal structure, which extension section comprises:

(1) an inner, metal anode terminal rod having a fixed end secured in electrical contact to the back face of said plate anode;

(2) an insulating sleeve around, but spaced apart from, said anode terminal rod; and (3) filler in the space between said anode terminal rod and said sleeve;

(B) an assembly second stage behind said first stage, which said second stage is housed within the insulating sleeve of said first stage and comprises:

(1) a wire lead free end for connecting with a free end of said anode terminal rod;

(2) a terminal connector securing the free ends of said anode terminal rod with said wire lead; and (3) a two-part connector sleeve of dielectric material, the connector sleeve being housed within the insulating sleeve of said first stage, with each said connector sleeve part being aligned annularly in said insulating sleeve, which connector sleeve parts surround the terminal connector as well as the free ends of said anode terminal rod and wire lead; and (C) an assembly third stage behind said second stage, said third stage comprising:

(1) a wire extending therethrough from outside said anode assembly; and (2) a sleeve member surrounding said wire while being spaced apart therefrom, said sleeve member comprising a pipe union member.

2. The anode assembly of claim 1, wherein said plate anode is an at least substantially circular convex, concave, or flat plate anode.

3. The anode assembly of claim 2, wherein said anode has a diameter within the range of from about 5 to about 20 inches, and said dielectric insulation is at least substantially circular and has a diameter within the range of from about 12 to about 30 inches.

4. The anode assembly of claim 1, wherein said dielectric insulation has a sealing member embedded within said insulation on the back face thereof.

5. The anode assembly of claim 1, wherein said dielectric insulation has its back face abutted against a face of said metal structure.

6. The anode assembly of claim 1, wherein said dielectric insulation is spaced apart from said metal structure by a spacer member placed there between.

7. The anode assembly of claim 1, wherein said anode terminal rod comprises valve metal, with the fixed end of said rod being welded to said anode.

8. The anode assembly of claim 1, wherein said insulating sleeve is a fiberglass-reinforced plastic sleeve which is tapered in an axial direction on its interior surface and epoxy potting compound is contained as the filler within the space between said sleeve and said anode terminal rod.

9. The anode assembly of claim 1, wherein said terminal connector fits around said wire lead and the free end of said anode terminal rod.

10. The anode assembly of claim 9, wherein said terminal connector is a silver plated beryllium copper cylindrical terminal connector which is crimp fit over said wire lead and spring fit over said anode terminal rod.

11. The anode assembly of claim 1, wherein said two-part connector sleeve is a fiberglass-reinforced plastic connector sleeve having both internal and external o-rings and said connector sleeve is securely affixed within said insulating sleeve.

12. The anode assembly of claim 1, wherein said pipe union member is a polyvinylchloride member.

13. The anode assembly of claim 1, wherein said plate anode is a valve metal anode having an electrocatalytic surface coating.

14. The anode assembly of claim 13, wherein said electrochemically active surface coating contains at least one oxide selected from the group consisting of platinum group metal oxides, magnetite, ferrite and cobalt oxide spinel.

15. The anode assembly of claim 13, wherein said electrochemically active surface coating contains a mixed crystal material of at least one oxide of a valve metal and at least one oxide of a platinum group metal.

16. A cathodic protection anode assembly for metal structures in water wherein a plate anode having front and back major faces is spaced apart by dielectric insulation, also having front and back major faces, from the metal structure to be protected, which anode assembly comprises, in sequence:

(A) an assembly first stage, including said plate anode positioned on the front face of said dielectric insulation, with the back face of said insulation facing said metal structure, said assembly first stage also including an extension section protruding through an aperture in said metal structure, which extension section comprises:

(1) an inner, metal anode terminal rod having a fixed end secured in electrical contact to the back face of said plate anode;

(2) an insulating sleeve around, but spaced apart from, said anode terminal rod; and (3) filler in the space between said anode terminal rod and said sleeve;

(B) a conduit assembly behind said first stage assembly and comprising a sleeve member surrounding said terminal rod and spaced apart therefrom, said sleeve member comprising a pipe union member; and (C) a junction assembly behind said conduit assembly and including junction means connecting a lead wire with the free end of said anode terminal rod, said junction assembly further comprising a housing for said junction means.

17. The anode assembly of claim 16, wherein said plate anode is an at least substantially circular convex, concave or flat plate anode.

18. The anode assembly of claim 17, wherein said anode has a diameter within the range of from about 5 to about 20 inches, and said dielectric insulation is at least substantially circular and has a diameter within the range of from about 12 to about 30 inches.

19. The anode assembly of claim 16, wherein said dielectric insulation has a sealing member embedded within said insulation on the back face thereof.

20. The anode assembly of claim 16, wherein said dielectric insulation has its back face abutted against a face of said metal structure.

21. The anode assembly of claim 16, wherein said dielectric insulation is spaced apart from said metal structure by a spacer member placed there between.

22. The anode assembly of claim 16, wherein said anode terminal rod comprises valve metal, with the fixed end of said rod being welded to said anode.

23. The anode assembly of claim 16, wherein said insulating sleeve is a fiberglass-reinforced plastic sleeve which is tapered in an axial direction on its interior surface and epoxy potting compound is contained as the filler within the space between said sleeve and said anode terminal rod.

24. The anode assembly of claim 16, wherein said junction means is a cable terminal secured to the free end of said anode terminal rod, said free end is a metal plated end, and said free end is encased in a protective envelope.

25. The anode assembly of claim 24, wherein said protective envelope is a sealant or a covering.

26. The anode assembly of claim 16, wherein said pipe union member is a polyvinylchloride member.

27. The anode assembly of claim 16, wherein said housing for said junction assembly is a conduit box.

28. The anode assembly of claim 16, wherein said plate anode is a valve metal anode having an electrocatalytic surface coating.

29. The anode assembly of claim 28, wherein said electrochemically active surface coating contains at least one oxide selected from the group consisting of platinum group metal oxides, magnetite, ferrite and cobalt oxide spinel.

30. The anode assembly of claim 28, wherein said electrochemically active surface coating contains a mixed crystal material of at least one oxide of a valve metal and at least one oxide of a platinum group metal.

31. A cathodic protection anode assembly for metal structures in water wherein a plate anode having front and back major faces is spaced apart by dielectric insulation, also having front and back major faces, from the metal structure to be protected, which anode assembly comprises, in sequence:

(A) an assembly first stage, including said plate anode positioned on the front face of said dielectric insulation, with the back face of said insulation facing said metal structure, said assembly first stage also including an extension section protruding through an aperture in said metal structure, which extension section comprises:

(1) an inner, metal anode terminal rod having a fixed end secured in electrical contact to the back face of said plate anode;

(2) an insulating sleeve around, but spaced apart from, said anode terminal rod;

(3) filler in the space between said anode terminal rod and said sleeve; and (B) a conduit assembly behind said first stage assembly and comprising a sleeve member surrounding said terminal rod and spaced apart therefrom, said sleeve member comprising a pipe union member.

32. The anode assembly of claim 31, wherein said plate anode is an at least substantially circular convex, concave or flat plate anode.

33. The anode assembly of claim 32, wherein said anode has a diameter within the range of from about 5 to about 20 inches, and said dielectric insulation is at least substantially circular and has a diameter within the range of from about 12 to about 30 inches.

34. The anode assembly of claim 31, wherein said dielectric insulation has a sealing member embedded in said insulation on the back face thereof.

35. The anode assembly of claim 31, wherein said dielectric insulation has its back face abutted against a face of said metal structure.

36. The anode assembly of claim 31, wherein said dielectric insulation is spaced apart from said metal structure by a spacer member placed there between.

37. The anode assembly of claim 31, wherein said anode terminal rod comprises valve metal, with the fixed end of said rod being welded to said anode.

38. The anode assembly of claim 31, wherein said insulating sleeve is a fiberglass-reinforced plastic sleeve which is tapered in an axial direction on its interior surface and epoxy potting compound is contained as the filler within the space between said sleeve and said anode terminal rod.

39. The anode assembly of claim 31, wherein said pipe union member is a polyvinylchloride member.

40. The anode assembly of claim 31, wherein said plate anode is a valve metal anode having an electrocatalytic surface coating.

41. The anode assembly of claim 40, wherein said plate anode is a metal anode of titanium, tantalum, niobium, zirconium, or alloys or intermetallic mixtures thereof.

42. The anode assembly of claim 40, wherein said electrochemically active surface coating contains at least one oxide selected from the group consisting of platinum group metal oxides, magnetite, ferrite and cobalt oxide spinel.

43. The anode assembly of claim 40, wherein said electrochemically active surface coating contains a mixed crystal material of at least one oxide of a valve metal and at least one oxide of a platinum group metal.

44. The anode assembly of claim 31, wherein said cable is connected to a rectifier.

45. The anode assembly of claim 1, wherein the plate anode has an active coating on the back face thereof as well as on the front face thereof.

46. A cathodic protection anode assembly for metal structures in water wherein a plate anode having front and back major faces is spaced apart by dielectric insulation, also having front and back major faces, from the metal structure to be protected, which anode assembly comprises:

(A) an assembly including said plate anode positioned on the front face of said dielectric insulation, with the back face of said insulation facing said metal structure, said assembly also including an extension section for protruding through an aperture in said metal structure, which extension section comprises:

(1) an inner, metal anode terminal rod having a fixed end secured in electrical contact to said plate anode;

(2) an insulating sleeve around, but spaced apart from, said anode terminal rod; and (3) filler in the space between said anode terminal rod and said sleeve; and with there being in said assembly (B) a sealing member embedded within the back face of said dielectric insulation.

47. In a cathodic protection anode assembly for metal structures in water wherein a plate anode having front and back major faces is spaced apart by dielectric insulation, also having front and back major faces, from the metal structure to be protected, which anode assembly includes said plate anode positioned on the front face of said dielectric insulation, with the back face of said insulation facing said metal structure, said assembly also including an extension section for protruding through an aperture in said metal structure, the improvement in said assembly comprising a dielectric shield as the dielectric insulation having an inner flange at an aperture of said shield, an insulating sleeve member as a part of said extension section, and an outer flange at an end of said sleeve member, said sleeve member outer flange being embedded within the aperture of said shield, with the inner flange of said shield coming together against the outer flange of said sleeve member, forming an interlocking joint wherein said extension section comprises (1) an inner, metal anode terminal rod having a fixed end secured in electrical contact to said plate anode; (2) the insulating sleeve member around, but spaced apart from, said anode terminal and; (3) filler in the space between said anode terminal rod and said sleeve.

* * * * *

UNITED STATES PATENT AND TRADEMARK OFFICE

CERTIFICATE OF CORRECTION

PATENT NO. : 5,372,687

DATED : December 13, 1994

INVENTOR(S) : Pohto et al

It is certified that error appears in the above-identified patent and that said Letters Patent is hereby corrected as shown below:

Claim 1, at column 10, line 21, after "rial, the", insert --said--.

Claim 1, at column 10, line 23, delete "said" at the beginning of the line.

Signed and Sealed this

Twenty-eight Day of March, 1995

*Attest:*

*Attesting Officer*

Bruce Lehman

BRUCE LEHMAN

*Commissioner of Patents and Trademarks*